US010847005B1

(12) United States Patent
Barth et al.

(10) Patent No.: US 10,847,005 B1
(45) **Date of Patent: *Nov. 24, 2020**

(54) SECURITY SYSTEM COMMUNICATOR AND KEYPAD DEVICE

(71) Applicant: Alarm.com Incorporated, Tysons, VA (US)

(72) Inventors: Adam T. Barth, Annandale, VA (US); Zackary Watson, Tysons, VA (US); Daniel Todd Kerzner, McLean, VA (US)

(73) Assignee: Alarm.com Incorporated, Tysons, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/546,572

(22) Filed: Aug. 21, 2019

Related U.S. Application Data

(63) Continuation of application No. 15/811,235, filed on Nov. 13, 2017, now Pat. No. 10,410,490.
(Continued)

(51) Int. Cl.
*G08B 13/196* (2006.01)
*G08B 25/14* (2006.01)
(Continued)

(52) U.S. Cl.
CPC ..... *G08B 13/19658* (2013.01); *G08B 25/14* (2013.01); *G08B 13/2494* (2013.01); *G08B 25/008* (2013.01); *G08B 25/01* (2013.01)

(58) Field of Classification Search
CPC .... G08B 19/005; G08B 25/009; G08B 29/14; G08B 13/2417; G08B 25/002;
(Continued)

(56) References Cited

U.S. PATENT DOCUMENTS 5,134,644 A 7/1992 Garton
5,517,185 A * 5/1996 Acimovic ..... H04L 12/2803 340/5.33
(Continued)

FOREIGN PATENT DOCUMENTS

EP 1959409 A2 8/2008
EP 1959409 A3 11/2009

OTHER PUBLICATIONS

International Search Report and Written Opinion in International Application No. PCT/US17/61572, dated Feb. 2, 2018, 11 pages.
(Continued)

*Primary Examiner* — Emily C Terrell
(74) *Attorney, Agent, or Firm* — Fish & Richardson P.C.

(57) ABSTRACT

Techniques are described for replacing a keypad of an existing security system within a property with a communication-enabled keypad device with dual functioning capabilities as a communicator device and a keypad device. In some implementations, data is received from a security panel of a property. A keypad bus protocol of the security panel is determined based on the data received from the security panel. Sensor data is received from one or more sensors located within the property. A monitoring system command that is not specified within a keypad bus of the security panel is determined based on based on the obtained sensor data. The monitoring system command is converted to a panel command using the keypad bus protocol. The panel command is transmitted on the keypad bus of the security panel.

20 Claims, 8 Drawing Sheets

Related U.S. Application Data

(60) Provisional application No. 62/421,467, filed on Nov. 14, 2016.

(51) Int. Cl.
*G08B 25/01* (2006.01)
*G08B 25/00* (2006.01)
*G08B 13/24* (2006.01)

(58) Field of Classification Search
CPC ..... G08B 25/008; G08B 25/06; G08B 25/10; G08B 13/24; G08B 13/2471; G08B 13/2477; G08B 13/248; G08B 25/004; G08B 13/2494; G08B 13/1958; G08B 25/01
USPC ..... 340/541
See application file for complete search history.

(56) References Cited

U.S. PATENT DOCUMENTS 5,943,394 A * 8/1999 Ader ..... H04M 11/04 379/40
8,289,161 B2 * 10/2012 Hosey ..... G08B 29/16 340/540
9,183,735 B1 11/2015 Pineau et al.
9,412,248 B1 8/2016 Cohn et al.
2003/0177372 A1 * 9/2003 Orlando ..... G08B 25/008 713/189
2005/0149717 A1 7/2005 Orlando et al.
2005/0253706 A1 11/2005 Spoltore et al.
2008/0204190 A1 8/2008 Cohn
2009/0077624 A1 3/2009 Baum et al.
2009/0138958 A1 5/2009 Baum
2013/0278410 A1 10/2013 Smith
2013/0321150 A1 * 12/2013 Koenig ..... G08B 25/008 340/541

OTHER PUBLICATIONS

PCT International Preliminary Report on Patentability in International Application No. PCT/US2017/061572, dated Aug. 1, 2019, 10 pages.
Extended European Search Report in European Application No. 17868639.0, dated Dec. 5, 2019, 12 pages.

* cited by examiner

SECURITY SYSTEM COMMUNICATOR AND KEYPAD DEVICE

CROSS-REFERENCE TO RELATED APPLICATION

This application is a continuation of U.S. application Ser. No. 15/811,235, filed Nov. 13, 2017, now allowed, which claims the benefit of U.S. Provisional Patent Application No. 62/421,467, filed on Nov. 14, 2016 and titled "SECURITY SYSTEM COMMUNICATOR AND KEYPAD DEVICE." Both of these prior applications are incorporated by reference in their entirety.

TECHNICAL FIELD

This disclosure application relates generally to security monitoring technology and more particularly to communication-enabled keypad devices.

BACKGROUND

Security systems of a property include a security panel for controlling and routing alarm signal data associated with a property. The security panel can exchange data communications with sensors placed in certain locations of the property and then typically use a cellular or phone connection to transmit security information to a central monitoring station operated by a security service provider. In response to detecting an alarm condition within the property, the security panel may transmit a signal to the central monitoring station, which then dispatches emergency responders to the property.

SUMMARY

Techniques are described to replace a keypad of an existing security system within a property with a communication-enabled keypad device with dual functioning capabilities as a communicator device and a keypad device. For instance, the communication-enabled keypad device can be used to monitor and intercept alarm signals on a preconfigured keypad bus of a security panel. The intercepted alarm signals can then be provided to devices associated with a separate monitoring server. In some examples, key press data received on the communication-enabled keypad device can be emulated in accordance with a keypad bus protocol of the security panel and used to control the operation of the security panel using a set of emulated key press signals. In this regard, the communication-enabled keypad device can be used to enhance the functionality of an existing security system using various features provided by a monitoring server without replacing the security panel and/or other associated sensors.

The installation of the keypad device as a replacement to an existing security keypad can be used to add another layer of programming settings for a user, or block programming settings that are available on the security panel that a user should not use. For example, a typical security system is limited to the devices that initially installed with it. However, the installed keypad device can be used to enable users to control Z-Wave devices, set motion detection windows for cameras, and manipulate other connected equipment. The keypad device can use any suitable short-range communication protocol to enable a user to control the keypad device. Additionally, many security panels have programming settings that are meant for one specific international region. The keypad device could determine what region the security panel is located in and then block users from changing the incorrect settings at the security panel. They keypad device can also prevent users from pressing keys at times when it would cause an interference at the security panel.

Implementations of the described techniques may include hardware, a method or process implemented at least partially in hardware, or a computer-readable storage medium encoded with executable instructions that, when executed by a processor, perform operations.

The details of one or more implementations are set forth in the accompanying drawings and the description below. Other features will be apparent from the description and drawings, and from the claims.

DESCRIPTION OF DRAWINGS

In the figures, like reference numbers represent corresponding parts throughout.

DETAILED DESCRIPTION

Figure 1A:
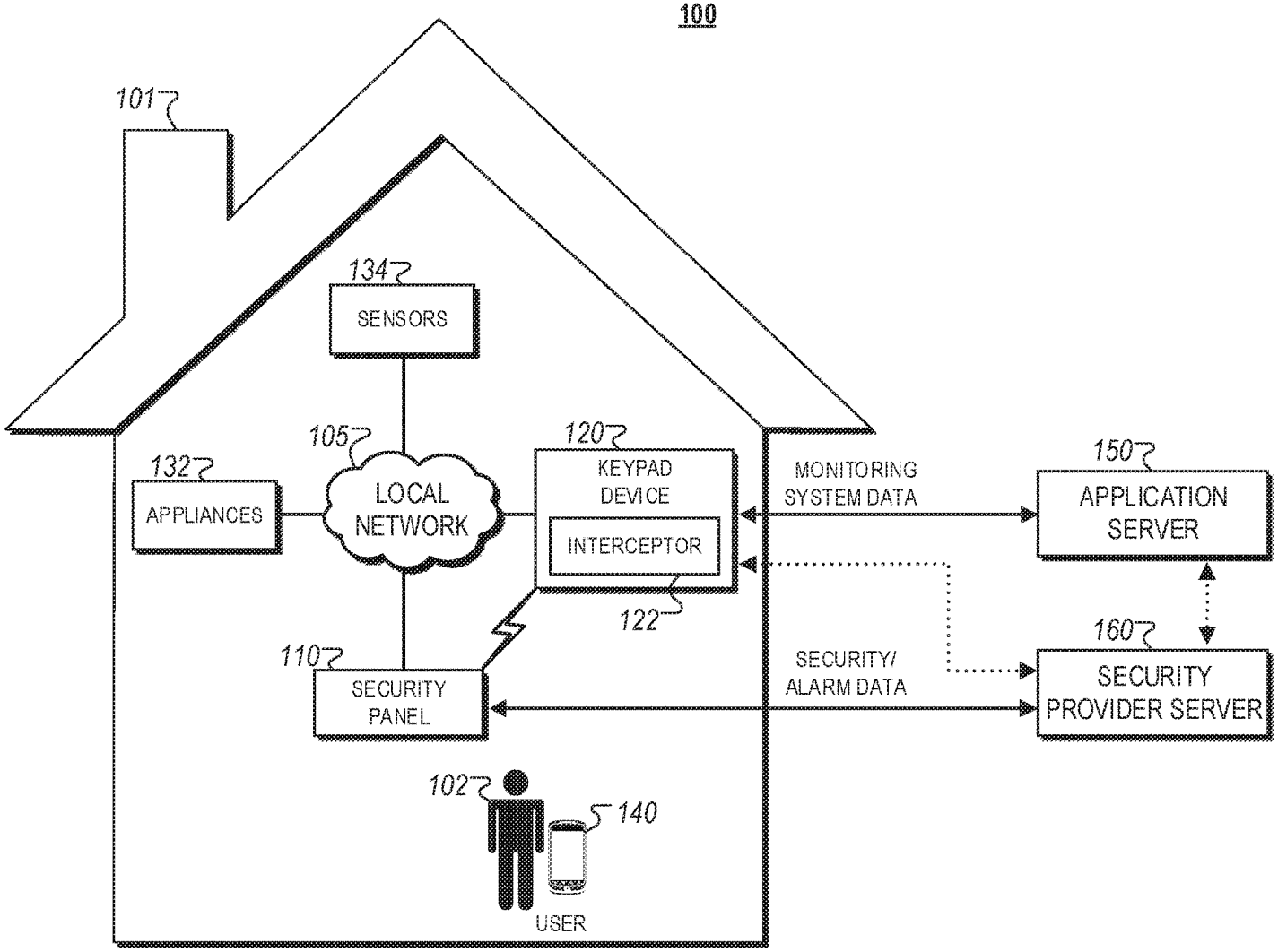
FIGS. 1A-1B illustrate examples of a system that includes a communication-enabled keypad device.

Techniques are described to replace a keypad of an existing security system within a property with a communication-enabled keypad device with dual functioning capabilities as a communicator device and a keypad device. For instance, the communication-enabled keypad device can be used to monitor and intercept alarm signals on a preconfigured keypad bus of a security panel. The intercepted alarm signals can then be provided to devices associated with a separate monitoring server. In some examples, key press data received on the communication-enabled keypad device can be emulated in accordance with a keypad bus protocol of the security panel and used to control the operation of the security panel using a set of emulated key press signals. In this regard, the communication-enabled keypad device can be used to enhance the functionality of an existing security system using various features provided by a monitoring server without replacing the security panel and/or other associated sensors.

As described throughout, a "security system" refers to a system designed to detect intrusions (e.g., unauthorized entries) into a particular building or areas. The security system may be configured to provide security alarms in response to detecting security breaches associated with the building or area that is monitored by the system. For example, the security system can be configured to protect against burglary, property damage, as well as personal protection against intrusions. The security system includes various components such as a security panel that receives sensor inputs, tracks arm/disarm status assigned to the property, and signals intrusions. The security system also includes sensors that are placed at the perimeter of the protected area, within it, or both. The sensors can detect intruders by a variety of methods, such as monitoring doors and windows for opening/closing, or monitoring unoccupied interiors for motions, sound, vibration or other activity. The security system also includes a wall-mounted security keypad that functions as a human-machine interface to the security system. The keypad can include buttons, indicator lights, or displays that allow a user to interact, control, or adjust settings for the security system. The keypad exchanges communications with the security panel on a keypad bus of the security panel.

As described throughout, a "monitoring system" refers to any type of property management system or server that does not include the security system described above. The monitoring system can be installed within the property where security system is already installed in order to enhance the capabilities of monitoring operations performed within the property. For example, the monitoring system can refer to a monitoring system or monitoring components installed in addition the security system described above. In this example, the monitoring system (or additional monitoring components) may include one or more keypads, additional sensors that provide enhanced monitoring functionality over the sensors included in the security system, additional controls that provide enhanced automation functionality over the security system, and one or more communicator devices that communicate with a monitoring server that is separate from the security system. As indicated above, a keypad and a communicator may be integrated in a single device that receives keypad input and communicates with the monitoring server, as well as communicating with the additional sensors and/or controls that provide enhanced functionality. In some examples, the monitoring system can include other types of components that are used to monitor operations that are not related to security (e.g., an HVAC monitoring system, an internet monitoring system, a power consumption monitoring system, a user tracking system, etc.). In this regard, installation of the monitoring system (e.g., one or more components, such as a keypad-communicator device) is performed after installation of the security system, and in some instances, can enable the addition of monitoring capabilities to the property relative to the property with security system alone installed.

Figure 1B:
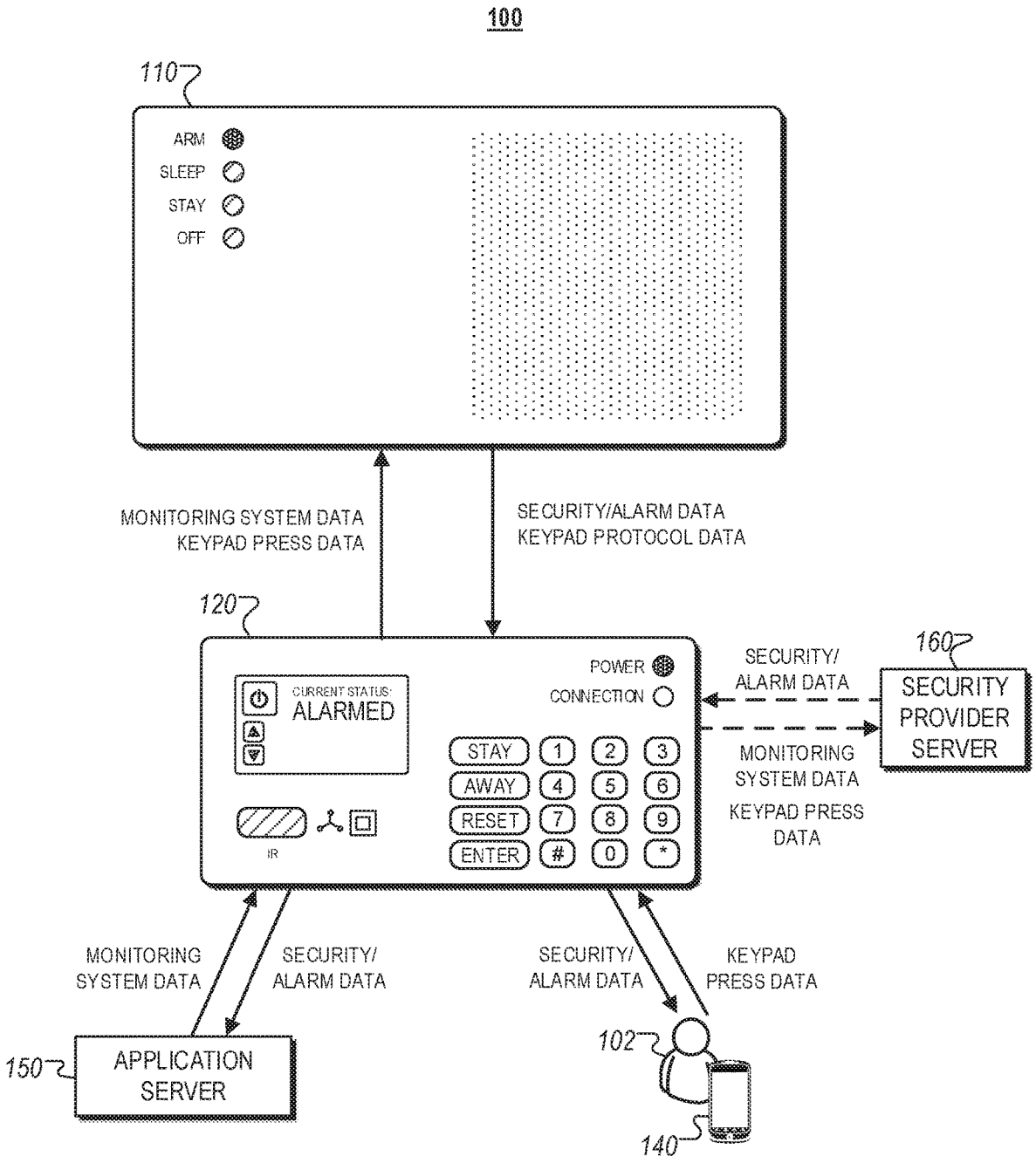

FIGS. 1A-1B illustrate examples of a system 100 that includes a communication-enabled keypad device 120. FIG. 1A illustrates various components of the system 100 within a property 101. FIG. 1B illustrates different types of data communications that are exchanged using the communication-enabled keypad device 120 (referred herein after as "keypad device 120").

Referring initially to FIG. 1A, the system 100 may include a security panel 110, a keypad device 120, sensors 134, and appliances 132 connected over a local network 105. The local network 105 enables the security panel 110, the keypad device 120, the sensors 134, and the appliances 132 to exchange various types of data communications that are illustrated in FIG. 1B. The security panel 110 can be also be configured to exchange alarm signal data with a security provider server 160, while the keypad device 120 may be configured to exchange monitoring system data associated with the sensors 134 and the appliances 132 to the application server 150.

Although FIG. 1 illustrates one property for clarity, the application server 150 may also exchange keypad devices 120 for multiple properties and/or structures. For example, the application server 150 may communicate directly with the keypad device 120 over a cellular network, or through other communications media and protocol (e.g., through the local network 105, over Bluetooth, ZigBee, etc.). Similarly, the security provider server 160 may monitor alarm signal data associated with security panels for multiple properties and/or signals.

In general, the architecture of the system 100 enables a third-party service provider other than the security provider associated with the server 160 to monitor and control alarm signal data associated with the security panel 110. For instance, data transmissions through the keypad device 120 can be used to adjust user experiences, e.g., through the user device 140 and/or the keypad device 120, that include alarm signal data and/or security monitoring operations performed by the security panel 110. As an example, the keypad device 120 can be used to intercept alarm signal information collected by the security panel 110 for output on either a display associated with the keypad device 120 and/or the user device 140. In another example, the keypad device 120 can be used to augment the monitoring processes performed by the security panel 110 by providing customized signals to adjust a status of an associated security system based on, for example, sensor data collected by the sensors 134 or data associated with the appliances 132. In this regard, the communication functionalities of the keypad device 120 can be used to enable various monitoring and/or reporting features within an existing security system without requiring a replacement of the security panel 110 and/or its associated sensors.

The local network 105 may be configured to enable electronic communications between devices connected to the local network 105. For example, the local network 105 may be configured to enable exchange of electronic communications between the security panel 110, the keypad device 120, the appliances 132, and the sensors 134. The local network 105 may include, for example, Local Area Networks (LANs), for example, Wi-Fi, analog or digital wired and wireless telephone networks, for example, a public switched telephone network (PSTN), Integrated Services Digital Network (ISDN), a cellular network, and Digital Subscriber Line (DSL), Ethernet, Internet Protocol (IP) over broadband, radio, television, cable, satellite, or any other delivery or tunneling mechanism for carrying data.

The local network 105 may include multiple networks or subnetworks, each of which may include, for example, a wired or wireless data pathway. The local network 105 may also include a circuit-switched network, a packet-switched data network, or any other network able to carry electronic communications (e.g., data or voice communications). For example, the local network 105 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The local network 105 may include one or more networks that include wireless data channels and wireless voice channels. The local network 105 may also be a wireless network, a broadband network, or a combination of networks including a wireless network and a broadband network.

The security panel 110 may be an electronic device that coordinates and/or monitors the operations of a security system installed within the property 101. For instance, the security panel 110 may be a wall-mounted unit that is connected to various detection devices such as door sensors, wall sensors, among others. The security panel 110 includes a security keypad that provides a user with various features such as setting various security statuses for the property (e.g., armed, stay, disarmed, quick exit, etc.), enabling a built-in siren system, transmitting alarm signals to the security provider server 160 in response to detecting a life-threatening condition within the property 101, among others.

The security system associated with the security panel 110 may be functioning independently of the system 100 and/or the monitoring system associated with the keypad device 120. For instance, the security system 110 may be an existing system installed within the property 101 when the keypad device 120 is installed in the property. For example, the security system may include a security keypad that is used for controlling settings and operations of the security panel 110 as described above. In such examples, the keypad device 120 can be installed as a replacement to the existing security keypad in order to enable data communications between the monitoring system associated with the application server 150 and the security panel 110 as described throughout.

The keypad device 120 may be an electronic device that coordinates and/or monitors the operations of devices connected to the local network 105 such as the appliances 132 and the sensors 134. In some instances, the keypad device 120 includes a controller and a network module. The controller is configured to control a system 100 (e.g., a HVAC system, an energy monitoring system) that includes the keypad device 120. In some examples, the controller may include a processor or other control circuitry configured to execute instructions of a program that controls operation of an alarm system. In these examples, the controller may be configured to receive input from sensors, detectors, or other devices included in the alarm system and control operations of devices included in the alarm system or other household devices (e.g., a thermostat, an appliance, lights, etc.). For example, the controller may be configured to control operation of the network module included in the keypad device 120.

The network module is a communication device configured to exchange communications over the local network 105. The network module may be a wireless communication module configured to exchange wireless communications over the local network 105. For example, the network module may be a wireless communication device configured to exchange communications over a wireless data channel and a wireless voice channel. In this example, the network module may transmit alarm data over a wireless data channel and establish a two-way voice communication session over a wireless voice channel. The wireless communication device may include one or more of a LTE module, a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module may also be a wired communication module configured to exchange communications over the local network 105 using a wired connection. For instance, the network module may be a modem, a network interface card, or another type of network interface device. The network module may be an Ethernet network card configured to enable the keypad device 120 to communicate over a local area network and/or the Internet. The network module also may be a voice-band modem configured to enable the alarm panel to communicate over the telephone lines of Plain Old Telephone Systems (POTS).

The keypad device 120 may also include a communication module that enables the keypad device 120 to communicate with other devices of the system 100. The communication module may be a wireless communication module that allows the keypad device 120 to communicate wirelessly. For instance, the communication module may be a Wi-Fi module that enables the keypad device 120 to communicate over a local wireless network at the property 101. The communication module further may be a 900 MHz wireless communication module that enables the keypad device 120 to communicate directly with a monitor control unit. Other types of short-range wireless communication protocols, such as Bluetooth, Bluetooth LE, Zwave, ZigBee, etc., may be used to allow the keypad device 120 to communicate with other devices in the property 101.

The keypad device 120 further may include processor and storage capabilities. The keypad device 120 may include any suitable processing devices that enable the keypad device 120 to operate applications and perform the actions described throughout this disclosure. In addition, the keypad device 120 may include solid state electronic storage that enables the keypad device 120 to store applications, configuration data, collected sensor data, and/or any other type of information available to the keypad device 120.

The keypad device 120 may exchange communications with the appliances 132, the sensors 134, and the application server 150, and the security provider server 160 using multiple communication links. The multiple communication links may be a wired or wireless data pathways configured to transmit signals from the appliances 132, the sensors 134, and the application server 150, and the security provider server 160 to the controller. The appliances 132, the sensors 134, and the application server 150, and the security provider server 160 may continuously transmit sensed values to the controller, periodically transmit sensed values to the keypad device 120, or transmit sensed values to the keypad device 120 in response to a change in a sensed value.

In some implementations, the keypad device 120 may monitor the operation of the electronic devices of the system 100 such as the appliances 132, the sensors 134, the internet access point 128, and the application server 150. For instance, the keypad device 120 may enable or disable the devices of the system 100 based on a set of rules associated with energy consumption, user-specified settings, and/or other information associated with the conditions near or within the property 101 where the system 100 is located. In some examples, the keypad device 120 may be used as a replacement to a traditional security panel (or monitor control unit) that is used to monitor and control the operations of the system 100. In other examples, the keypad device 120 may coordinate monitoring operations with a separate security panel of the system 100. In such examples, the keypad device 120 may monitor particular activities of the devices of the system 100 that are not monitored by the security panel, or monitor the operation of particular devices that are not monitoring by the security panel.

The keypad device 120 may include an interceptor 122 that is configured to intercept incoming communications on a keypad bus of the security panel 110. For instance, as described above, in implementations where the keypad device 120 is installed as a replacement of an existing security keypad device connected on a keypad bus of the security panel 110, the interceptor 122 may be capable of converting signals transmitted on the keypad bus by the security panel 110. For example, event log data of the security panel 110 that are communicated over the keypad bus can be converted from a proprietary data format for the security system of the security panel 110 to a non-proprietary format that is capable of being processed by other components of the system 100 that were not originally installed in the property 101 with the security system (e.g., the sensors 134, the appliances 132). In addition, after the keypad device 120 is installed into the property 101, the interceptor 122 enables the keypad device 120 to identify incoming data communications with the security panel 110 (e.g., incoming communications from the security provider server 160) and reroute the communications through the system 100 in addition to security panel 110. More particular descriptions related to the interception of signals associated with the security panel 110 are described below with respect to FIG. 3.

The property 101 may include various monitoring devices that are each capable of performing individual monitoring operations and/or capable to performing a set of coordinated operations based on instructions received from either the keypad device 120 or the application server 150. For instance, the property 101 may include the appliances 132, the sensors 134, and other devices that provide monitoring data associated with devices, areas, or individuals located nearby or within the premises of the property 101. As an example, the sensors 134 located on the property 101 may provide video, still images, or other monitoring data, and may provide data via a live feed, transmit data to be stored in a remote location, store data locally for review at a later time, etc. As another example, sensors 134 located on the property 101 may include motion sensors, heat sensors, pressure sensors, resistive sensors, etc. that periodically collected sensed data indicating conditions of the property 101. The sensors 134 may communicate with the system 100 and transmit monitoring data for processing to the keypad device 120. In some examples, the sensors 134 may store collected data locally or transmit monitoring data to be stored in a remote location (e.g., the application server 150).

The appliances 132 may be home automation devices connected to the local network 105 that are configured to exchange electronic communications with other devices of the system 100. The appliances 132 may include, for example, connected kitchen appliances, controllable light sources, safety and security devices, energy management devices, and/or other types of electronic devices capable of exchanging electronic communications over the local network 105. In some instances, the appliances 132 may periodically transmit information and/or generated data to the keypad device 120 such that the keypad device 120 can automatically control the operation of the appliances 132 based on the exchanged communications. For example, the keypad device 120 may operate one or more of the appliances 132 based on a fixed schedule specified by the user. In another example, the keypad device 120 may enable or disable one or more of the appliances 132 based on received sensor data from the sensors 134.

The sensors 134 may include one or more of a contact sensor, a motion sensor, a glass break sensor, an occupancy sensor, or any other type of sensor that can be included in an alarm or security system. The sensors 134 may also include an environmental sensor, such as a temperature sensor, a water sensor, a rain sensor, a wind sensor, a light sensor, a smoke detector, a carbon monoxide detector, an air quality sensor, etc. The sensors 134 may further include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the sensors 134 may include a radio-frequency identification (RFID) sensor that identifies a particular article that includes a pre-assigned RFID tag.

In some implementations, the sensors 134 may include one or more cameras. The cameras may be video/photographic cameras or other type of optical sensing devices configured to capture images. For instance, the cameras may be configured to capture images of an area within a building monitored by the keypad device 120. The cameras may be configured to capture single, static images of the area and also video images of the area in which multiple images of the area are captured at a relatively high frequency (e.g., thirty images per second). The cameras may be controlled based on commands received from the keypad device 120.

The cameras may be triggered by several different types of techniques. For instance, a Passive Infra Red (PIR) motion sensor may be built into the cameras and used to trigger the cameras to capture one or more images when motion is detected. The cameras also may include a microwave motion sensor built into the camera and used to trigger the cameras to capture one or more images when motion is detected. The cameras may have a "normally open" or "normally closed" digital input that can trigger capture of one or more images when external sensors (e.g., the sensors 134, PIR, door/window, etc.) detect motion or other events. In some implementations, the cameras receive a command to capture an image when external devices detect motion or another potential alarm event. The cameras may receive the command from the controller or directly from one of the sensors 134.

In some examples, the cameras trigger integrated or external illuminators (e.g., Infra Red, Z-wave controlled "white" lights, etc.) to improve image quality when the scene is dark. An integrated or separate light sensor may be used to determine if illumination is desired and may result in increased image quality.

The cameras may be programmed with any combination of time/day schedules, system "arming state", or other variables to determine whether images should be captured or not when triggers occur. The cameras may enter a low-power mode when not capturing images. In this case, the cameras may wake periodically to check for inbound messages from the controller. The cameras may be powered by internal, replaceable batteries if located remotely from the keypad device 120. The cameras may employ a small solar cell to recharge the battery when light is available. Alternatively, the cameras may be powered by the controller's 112 power supply if the cameras are co-located with the controller.

The user device 140 may be an electronic device associated with a user 102 of the property 101. For example, the user 102 may be a tenant or a property owner that resides within or otherwise uses the property 101 on a periodic basis. The user device 140 can include one or more native applications. The native applications refer to software/firmware programs running on the corresponding mobile device that enables the user interface and features described throughout. The user device 140 may load or install the native surveillance application based on data received over a network (e.g., the local network 105) or data received from local media. The native application is capable of operating on various mobile devices platforms. The native application also enables the user device 140 to receive and process data from the system 100.

In some implementations, the user device 140 communicates with and receives system data from the keypad device 120 or the application server 150 using a communication link. In addition, the user device 140 may also be capable of exchanging communications with the security panel 110 through the use of the interceptor 122 of the keypad device 120. For instance, the user device 140 may communicate with the keypad device 120 using various local wireless protocols such as Wi-Fi, Bluetooth, Zwave, ZigBee, HomePlug (Ethernet over powerline), or wired protocols such as Ethernet and USB, to connect the user device 140 to local security and automation equipment. The user device 140 may also connect locally to the sensors 134, the appliances and other devices. The local connection may improve the speed of status and control communications because communicating through the local network 105 with a remote server (e.g., the application server 150) may be significantly slower.

The application server 150 may be an electronic device configured to provide monitoring services by exchanging electronic communications with the keypad device 120 and the user device 140 over the local network 105. For example, the application server 150 may be configured to monitor events (e.g., HVAC activity data, user activity data, energy consumption) collected by the keypad device 120 and/or other devices connected over the local network 105. In this example, the application server 150 may exchange electronic communications with the network module included in the keypad device 120 to receive information regarding events detected by the keypad device 120. The application server 150 also may receive information regarding events from the user device 140 (e.g., system configuration data, set point temperature adjustments, and/or user inputs corresponding to user preferences).

The application server 150 may also exchange data communications with the user device 140. For instance, as described above, the application server 150 may be associated with a native application that runs on the user device 140. The application server 150 may be associated with the application in order to collect various types of information collected by the application on the user device 140. For example, the application server 150 may obtain data indicating remote configurations of the system 100 submitted by the user 102 through the user device 140 (e.g., heating/cooling cycles associated with an HVAC unit), user preferences associated with the operation of components of the system 100 (e.g., set point temperature updates to a thermostat at different times), or data that is monitored by the user device 140 through the application (e.g., an alarm status associated with a carbon monoxide sensor). In this regard, data communications between the application server 150 and the application of the user device 140 enables the application server 150 to obtain various types of monitoring data associated with the property 101 and the user 102.

The application server 150 may store sensor and image data received from the keypad device 120 or the user device 140 and then perform analysis of the received sensor and image data. Based on the analysis, the application server 150 may communicate with and control aspects of the keypad device 120 or the user device 140. For example, in response to determining that one of the appliances 132 requires routine maintenance, the application server 150 may transmit a notification to either the keypad device 120 or the user device 140 indicating maintenance information related to the appliance. In another example, in response to determining that sensor data indicates an emergency condition within the property 101 (e.g., a fire, a medical emergency associated with a user within the property 101), the application server 150 may automatically transmit an alert notification to either the keypad device 120, the user device 140, or a system associated with an emergency responder.

The security provider server 160 may be an electronic device configured to provide security/alarm monitoring services by exchanging electronic communications with the security panel 110 over a telephone line such as Plain Old Telephone Service (POTS), Integrated Services Digital Network (ISDN), or Voice over IP (VoIP) network. For example, the security provider server 160 may be configured to monitor alarm events (e.g., possible intrusions, security breaches, disruptions to a specified boundary) near or within the property 101 based on data collected by the security panel 110 and its associated sensors. As described above, the security provider server 160 may be managed and operated by a security service provider that is distinct from the service provider that manages and/or operates the application server 150 discussed above.

The security provider server 160 periodically exchanges communications with the security panel 110 in order to identify the occurrence of alarm events within the property 101. For example, in response to sensor data indicating a possible intrusion within the property, the security panel 110 may transmit a signal to the security service provider 110, which can then then forward an alert notification to an emergency responder to indicate the possible intrusion within the property. The security provider server 160 may also transmit data communications to the security panel 110 (e.g., firmware or software updates, signals indicating whether a submitted security code on a security panel correspond to the configured security code for the property, etc.).

Referring now to FIG. 1B, the keypad device 120 enables data communications between the security panel 110, the application server 150, and the user device 140 utilizing a preconfigured keypad bus of the security panel 110. For instance, as described above, the keypad device 120 can be installed as a replacement of an existing security keypad that is associated with the security panel 110.

After installation of the keypad device 120, the interceptor 122 of the keypad device 120 can be used to enable the keypad device 120 to intercept incoming data signals through the security panel 110 (e.g., data communications from the security provider server 160). The keypad device 120 may also process the intercepted signals to formats that are understandable by the various components of the monitoring system (e.g., the appliances 132, the sensors 134, the user device 140, the application server 150). For example, incoming security log data to the security panel 110 can be used to formatted from a proprietary format associated with the security system to a common format that is capable of being used by the system 100 to automatically adjust a security status designated to the property 101 by the monitoring system associated with the application server 130.

In operation, the keypad device 120 can be used to enable communications between devices associated with an existing security system of the property 101 (e.g., the security panel 110 and associated servers) and a monitoring system of the property 101 (e.g., the application server 150, the appliances 132, the sensors 134, or the user device 140) installed in addition to the existing security system of the property 101. In this regard, the keypad device 120 enables bi-directional data communications between the security system and the monitoring system to impart additional monitoring capabilities to either the security system or the monitoring system as described in more detail below.

Referring now the examples depicted in the figure, the keypad device 120 can obtain security/alarm data and keypad protocol data from the security panel 110. The security/alarm can include, for example, a present arm/disarm status for the property 101 designated by the security system. The keypad protocol data can represent configurations that enable the security panel 110 to interpret data transmitted on the keypad bus that connected a prior security keypad to the security panel.

The keypad device 120 can then use the security/alarm data and/or the keypad protocol data to exchange communications with the application server 150 and/or the user device 140. For example, in the first instance, the obtained security/alarm data can be relayed to the application server 150 to inform a present arm/disarm status of the property as designated by the security panel 110. In the second instance, the obtained security/alarm data can be used to provide the arm/disarm status of the property through a native application that executes on the user device 140. In both of these examples, the transmission of the security system status is not possible without the use of the keypad device 120 because either the security system is an older system that lacks the capabilities to exchange data communications with aftermarket devices, or because the security keypad device lacks the capability to transmit wireless signals to other devices that are not connected on the keypad bus of the security panel 110.

The keypad device 120 may also enable the transmission of monitoring system data from the application server 150 and/or the user device 140 to security panel 110, which can then enable the configuration and/or operation of the security system. In the first instance, the application of the user device 140 can provide the user 102 with a user interface that includes keys corresponding to physical keys placed on the keypad device 120. The user input received on the application corresponding to button presses can then be transmitted to the keypad device 120. The keypad device 120 then processes the user input data to generate keypad press data that can be interpreted by the security panel 110. The processed data is then transmitted from the keypad device 120 to the security panel 110 over the keypad bus of the security panel 110. In this regard, the keypad device 120 enables data communications between the user device 140 in order to allow the user 102 to remotely provide keypress data without having to physically access the keypad device 120.

In the second instance, the keypad device 120 may receive data from the application server 150 related to a current monitoring status of the property 101. The keypad device 120 can then forward data received from the application server 150 to the security panel 110 in order to trigger an alarm signal by the security panel 110. As an example, the keypad device 120 may receive data from the application server 150 that indicates aberrant motion detected within the property 101 (e.g., based on data collected by occupancy sensors placed within the property). In response, the keypad device 120 may process the detected motion data to generate an alarm signal that is capable of being transmitted to the security panel 110. The alarm signal is then transmitted to the security panel 110 to trigger an alarm condition by the security system within the property. In this regard, keypad device 120 enables suspicious data that is typically not monitored and/or accessible by the security system (e.g., occupancy data collected by motion sensors of the monitoring system) to be used to trigger alarm conditions by the security system.

As described above, in the examples depicted in FIGS. 1A and 1B, the keypad device 120 can be used as a communicator device and a keypad device to enhance the functioning capabilities of an existing security system within a property. Additionally, or alternatively, in some implementations, the keypad device 120 can be used to replace a traditional communicator associated with the security panel 110 within the security system. In such implementations, the keypad device 120 is capable of exchanging data communications directly with the security provider server 160 without having to route the communications through the security panel 110. As an example, the keypad device 120 can transmit data collected by sensors associated with the security system, keypad press data, and/or monitoring system data in a manner similar to the security panel 110 described above. As a result, in such implementations, the keypad device 120 can be used to enable data communications between the application server 150 and the security provider server 160 without the use of the security panel 110.

Additionally, or alternatively, in some implementations, the application server 150 may be capable of exchanging data communications directly with the security provider server 160 without having to route communications through devices within the property 101 (e.g., the security panel 110 and the keypad device 120). As an example, once the keypad device 120 is installed within the property 101, the keypad device 120 may transmit intercepted security system data from the security provider server 160 to the application server 150. The application server 150 can then use the intercepted security system data to identify a suitable network to exchange communications directly with the security provider network 160 without having to route transmissions through the local network 105. In some instances, the application server 150 and the security provider server 160 exchange communications over a cellular network that is operated and managed by the security provider server 160.

Figure 2A:
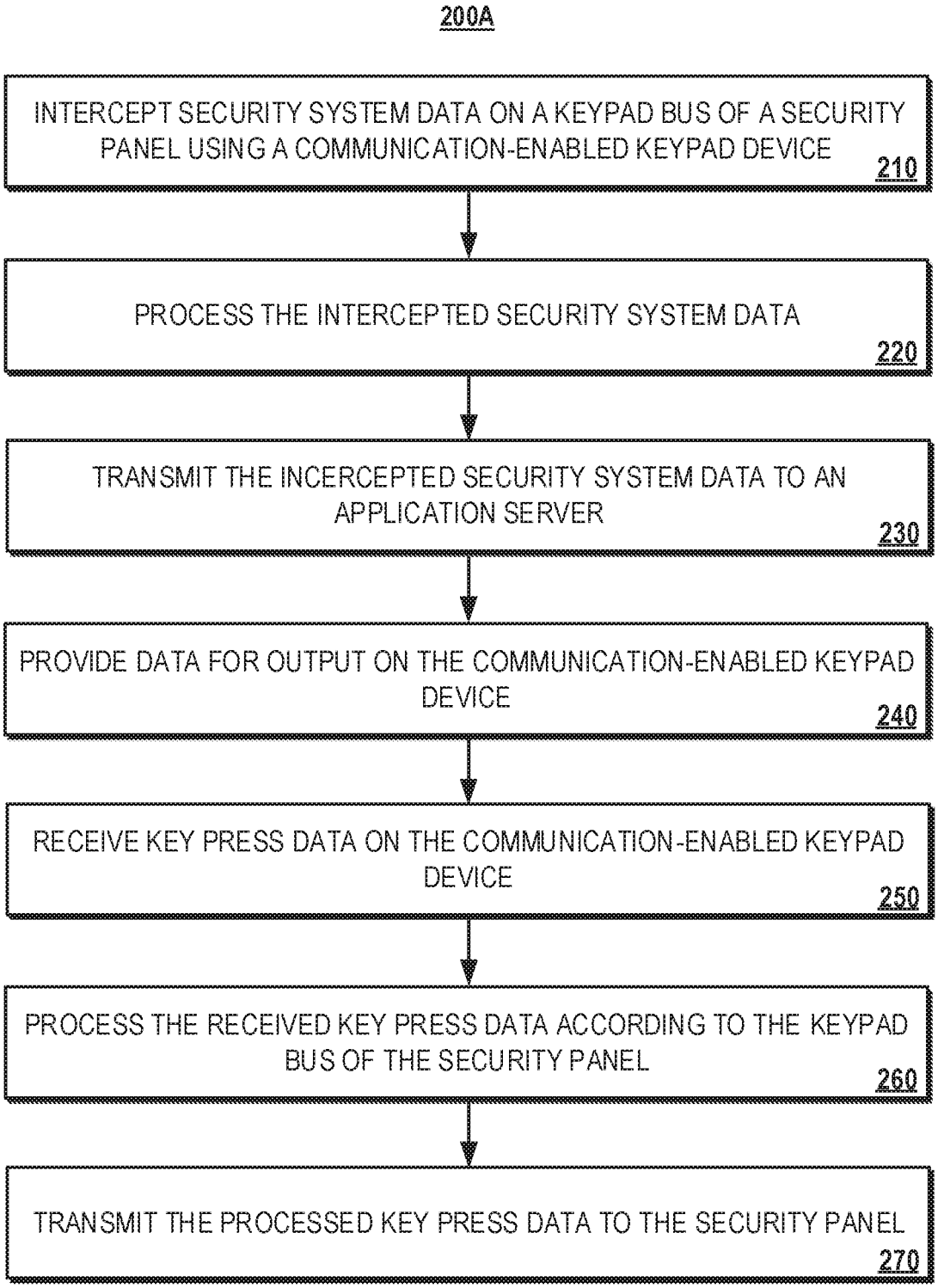
FIG. 2A illustrates an example of a process for executing operations using a communication-enabled keypad device.

FIG. 2A illustrates an example of a process 200A for executing operations using a communication-enabled keypad device. Briefly, the process 200A may include intercepting security system data on a keypad bus of a security panel using a communication-enabled keypad device (210), processing the intercepted security system data (220), transmitting the intercepted security system data to an application server (230), providing data for output on the communication-enabled keypad device (240), receiving key press data on the communication-enabled keypad device (250), processing the received key press data according to the keypad bus of the security panel (260), and transmitting the processed key press data to the security panel (270).

In more detail, the process 200A may include intercepting security system data on a keypad bus of a security panel using a communication-enabled keypad device (210). For instance, once the keypad device 120 is installed as a replacement to a preexisting security keypad of the security system, the keypad device 120 may be configured to monitor data communications that take place over the keypad bus of the security panel 110. For example, as described more particularly with respect to FIG. 3, the keypad device 120 may monitor incoming data transmissions from the security provider server 160, data communications relayed to the keypad device 120 on the keypad bus, among other types of data signals.

The process 200A may include processing the intercepted security system data (220). For instance, the keypad device 120 may convert the intercepted security system data to a format that is capable of being processed by different devices associated with the monitoring system (e.g., the appliances 132, the sensors 134, the user device 140, and/or the application server 150). In some implementations, the conversation can be performed with the use of a keypad bus protocol repository 510 and a security panel command repository 520 illustrated in FIG. 5. In such implementations, the repositories 510 and 520 can be used to identify mappings between individual security system commands and corresponding monitoring system commands. The mappings can then be used to convert a particular command indicated by an interpreted data communication to a format that is capable of being interpreted by the various devices of the monitoring system.

The process 200A may include transmitting the intercepted security system data to an application server (230). For instance, after converting the intercepted security system data to a format that is capable of being processed by the monitoring system, the keypad device 120 then transmits the converted security system data to the application server 150. In some implementations, the converted security system data is transmitted over a designated cellular network that enables the data communications between the keypad device 120 and the application server 150. For example, as described above, the keypad device 120 can include a network module with cellular connectivity to exchange data communications with the application server 150. In other implementations, the converted security system data is transmitted over the local network 105, which then allows for the transmission of the converted security system data over the Internet.

The process 200A may include providing data for output on the communication-enabled keypad device (240). For instance, in addition to providing the converted security system data to the application server 150, the keypad device 120 may also provide the intercepted security system data for output on a display associated with the keypad device 120. For example, as illustrated in FIG. 1B, the keypad device 120 may display a current security system status (e.g., "ALARMED"), which is obtained based on intercepted communications with the security panel 110, on an associated display unit on the keypad device 120. In this regard, the keypad device 120 can be used as a replacement keypad that provides at least the same functionalities, and in some instances, greater functionalities, compared to the functionalities of a prior security keypad of the security system. For example, if the prior security keypad was not associated with a display, then the display associated with the keypad device 120 can be used to provide an additional user interface for displaying security system information.

The process 200A may include receiving key press data on the communication-enabled keypad device (250). For instance, the keypad device 120 may receive key press data on keypad buttons of the keypad device 120. As illustrated in FIG. 1, the keypad of the keypad device 120 can include buttons for numbers (e.g., 1 to 9), and buttons to perform specified actions (e.g., "stay," "away," "reset," "enter"). The key press data received on the keypad device 120 can then be relayed on a keypad bus of the security panel 110 to perform the specified actions related to the security system.

The process 200A may include processing the received key press data according to the keypad bus of the security panel (260). For instance, the received key press data on the keypad device 120 can be converted in order to be transmitted over the keypad bus of the security panel 110. For instance, because the keypad device 120 is an aftermarket device that is not specifically installed with the security system, key press data received on the keypad device 120 is not immediately capable of being communicated on the keypad bus of the security panel 110. As a result, in some implementations, the keypad device 120 accesses a keypad bus protocol repository 510 that enables the conversion of received key press data to corresponding key press data that is capable of being transmitted to the security panel 110 over the keypad bus. For example, the keypad device 120 may identify corresponding keypad bus commands for the received key press data and then transmit the keypad bus commands for output to the security panel 110. In another example, the keypad device 120 may convert one or more portions of the received key press data to a format that is capable of being processed on the keypad bus (e.g., conversion from a generic format to a proprietary format).

The process 200A may include transmitting the processed key press data to the security panel (270). For instance, the keypad device 120 may transmit the processed key press data for output to the security panel 110 on its keypad bus. In some instances, key press data received on the keypad of the keypad device 120 can be converted to a format that is capable of being processed on the keypad bus of the security panel 110. In other instances, the keypad device 120 identifies a corresponding key press command associated with the keypad bus, which is then transmitted for output to the security panel 110.

In some implementations, the keypad device 120 may also transmit other types of data besides key press data, such as monitoring system data, for output to the security panel 110. For instance, as described more particularly below with respect to FIG. 5, the keypad device 120 may transmit data obtained from the appliances 132, the sensors 134, the user device 140, and/or the applications server 150 for output on the security panel 110 using similar conversion techniques described above.

Figure 2B:
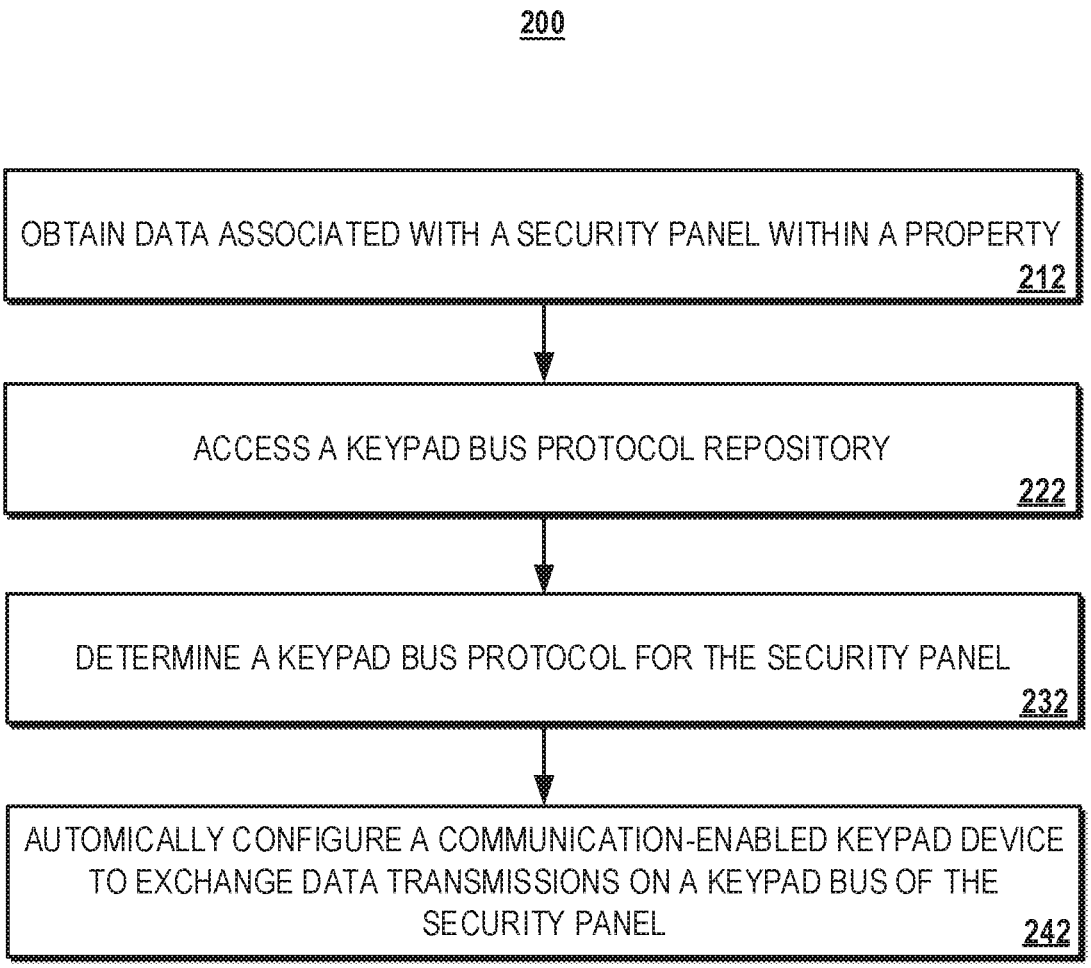
FIG. 2B illustrates an example of a process for automatically configuring a communication-enabled keypad device to function in accordance with a keypad bus protocol of a security panel.

FIG. 2B illustrates an example of a process 200B for automatically configuring a communication-enabled keypad device to function in accordance with a keypad bus protocol of a security panel. Briefly, the process 200B may include obtaining data associated with a security panel within a property (212), accessing a keypad bus protocol repository (222), determining a keypad bus protocol for the security panel (232), and automatically configuring a communication-enabled keypad device to exchange data transmissions on a keypad bus of the security panel (242).

In more detail, the process 200B may include obtaining data associated with a security panel within a property (212). For instance, the keypad device 120 may obtain data associated with the security panel 110 within the property 101. As described above, the data can be obtained by intercepting the incoming data transmissions on a keypad bus of the security panel 110. Examples of obtained security system data relating to a security system status, or sensor data collected by sensors associated with the security panel 110.

The process 200B may include accessing a keypad bus protocol repository (222). For instance, as described above with respect to FIG. 2B, after obtaining the security system data, the keypad device 120 may access a keypad bus protocol repository to automatically identify an applicable keypad bus that corresponds to the keypad bus connecting the keypad device 120 and the security panel 110. For instance, the keypad bus protocol repository may include various protocols used by the keypad buses of security systems made by different manufacturers.

The process 200B may include determining a keypad bus protocol for the security panel (232). For instance, the keypad device 120 may initially determine identification information for the security panel 110, and then use the identification information to parse the keypad bus protocol repository to identify the appropriate keypad bus protocol that can be used for the keypad bus of the security panel 110. In some instances, this process is automatically performed when the keypad device 120 is initially installed as a replacement for an existing security keypad associated with the security panel 110. In such instances, the keypad device 120 is capable of accessing the keypad bus protocol in order to identify the keypad bus without manual configuration by installation personnel.

The process 200B may include automatically configuring a communication-enabled keypad device to exchange data transmissions on a keypad bus of the security panel (242). For instance, after identifying the applicable keypad bus information and the corresponding keypad bus protocol within the keypad bus protocol repository, the keypad device 120 may automatically configure its communication module to operate in accordance with the keypad bus of the security panel 110. As described above, because this process can be performed based on the use of identification information to parse through the keypad bus protocol repository, the configuration of the keypad device 120 can be performed without receiving manual input from installation personnel to configure the keypad device 120.

Figure 3:
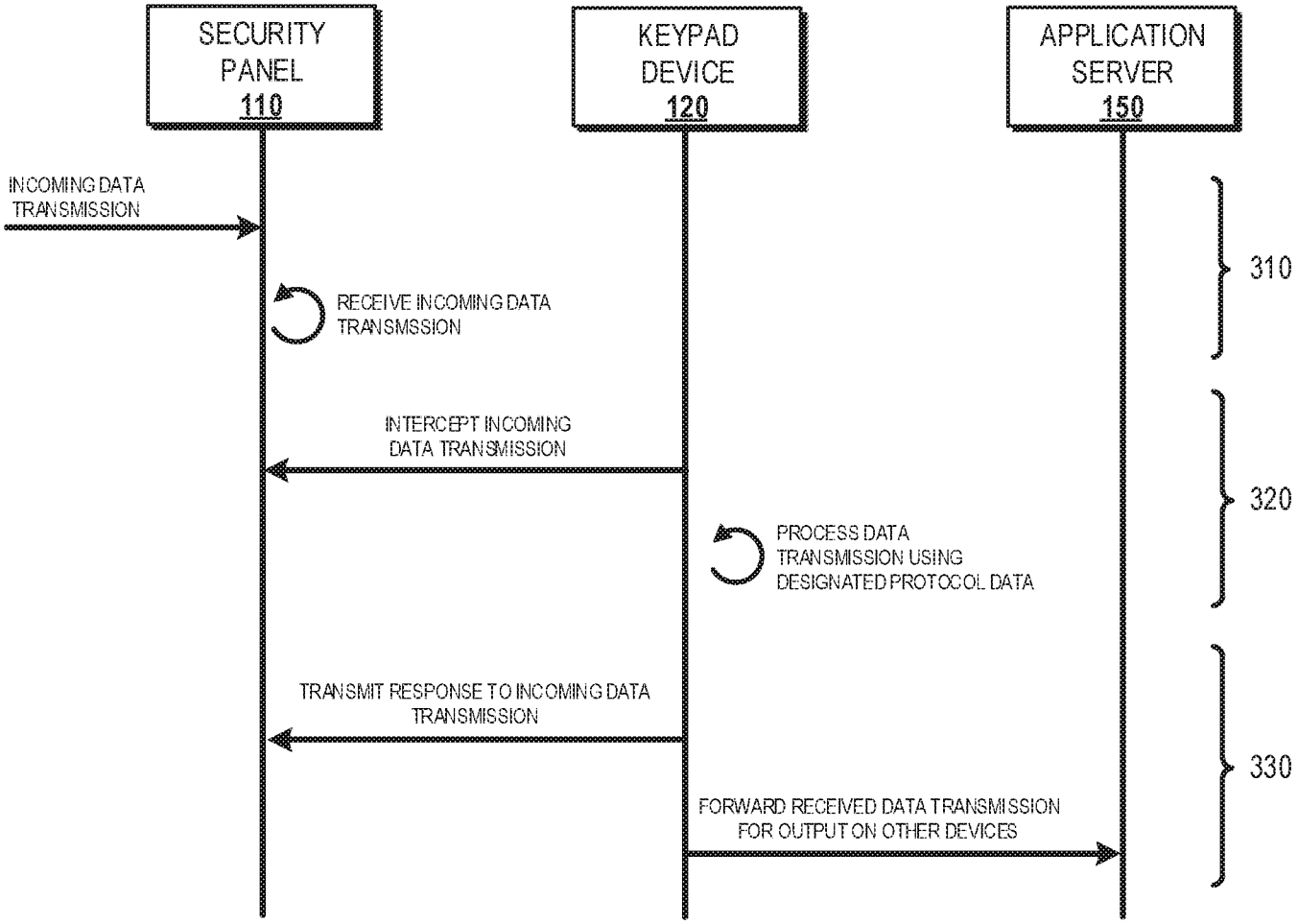
FIG. 3 illustrates an example of intercepting alarm signals on a keypad bus of a security panel using a communication-enabled keypad device.

FIG. 3 illustrates an example of intercepting alarm signals on a keypad bus of a security panel using a communication-enabled keypad device. Briefly, at step 310, the security panel 110 initially receives an incoming data transmission from the security provider server 160 and then processes the incoming data transmission. At step 320, in response to detecting the incoming data transmission from the security provider server 160, the keypad device 120 transmits an intercept signal to the security panel 110 and then processes the data transmission using designated protocol data. At step 330, the keypad device 120 can either transmit a response to the incoming data transmission to the security provider server 160 or forward the received data transmission for output to other devices such as the application server 150.

In more detail, at step 310, the security panel 110 initially receives and processes an incoming data transmission from the security provider server 160. For instance, the incoming data transmission may relate to security system data that is communicated on the keypad bus that connects the security panel 110 and the keypad device 120. Examples of incoming data transmissions can include updates to current the status of the security system (e.g., "armed," "disarmed," "stay), configuration information transmitted from the security provider server 160 that adjusts the operation of the security panel 110, or key press data provided on the keypad device 120 that is to be communicated on the keypad bus to the security panel 110. In other instances, the incoming data transmission may represent communications from the security provider that is intended to be provided to the user through the original security keypad of the security system.

Referring now to step 320, the keypad device 120 intercepts the incoming data transmission on the keypad bus of the security panel 110. As described above, the keypad device 120 can be configured to monitor the communications over the keypad bus such that, upon detecting an incoming data transmission, the interceptor 122 intercepts the incoming data and then provides the intercepted data to the keypad device 120 for conversion and/or interpretation using the techniques described above with respect to FIGS. 2A and 2B. For example, security system commands that are transmitted to the security panel 110 can either be deconstructed and reconstructed in a format that is capable of being processed by devices of the monitoring system, or used to identify an analogous monitoring system commands for the security system commands.

In some implementations, the keypad device 120 can process the incoming data transmission based on accessing a keypad bus protocol repository and a security panel command repository to determine how to convert the security system data or commands to corresponding monitoring system data or commands. For example, as described in more detail with respect to FIG. 5, each repository can include mappings between corresponding security system data and monitoring system data, which enables the keypad device 120 to communicate the content of the security system data in a format that is capable of being processed by devices of the monitoring system.

Referring finally to step 330, the keypad device 120 can either transmit a response to the incoming data transmission to the security panel 110, or forward the incoming data transmission to application server 150 or other devices associated with the monitoring system. In the first instance, the keypad device 120 may provide information associated with the incoming data transmission for output on a display of the keypad device 120, and in response to receiving key press data from the user 102, transmit the received key press data to the security panel 110. As an example, the security provider server 160 may transmit a request to the security panel 110 to confirm a false alarm associated with a detected alarm event at the property 101. The interceptor 122 of the keypad device 120 then intercepts the incoming request to the security panel 110, and then provides a user interface on a display of the keypad device 120 to enable the user 102 to provide key presses indicating whether the detected alarm detect is a false alarm. The key press data received from the user is then converted to a format for the keypad bus, and then provided to the security panel 110 as a response to the incoming request from the security provider server 160.

In the second instance, the keypad device 120 may forward information associated with the incoming data transmission for output on the application server 150 and other devices such as the appliances 132, the sensors 134, and the user device 140. As an example, an incoming signal indicating a recent change to a security status of the property 101 (e.g., based on data received from sensors associated with the security panel 110) can be intercepted by the keypad device 120 on the keypad bus of the security panel 110. The incoming signal can then be processed using techniques described above, and then forwarded to devices associated with the monitoring system such as the application server 150. The forwarded signal can then be used to generate an alert notification that is displayed to the user 102. For instance, the alert notification can be provided through the application of the user device 140 so that the user 102 can view status updates remotely when located outside of the property 101.

Figure 4:
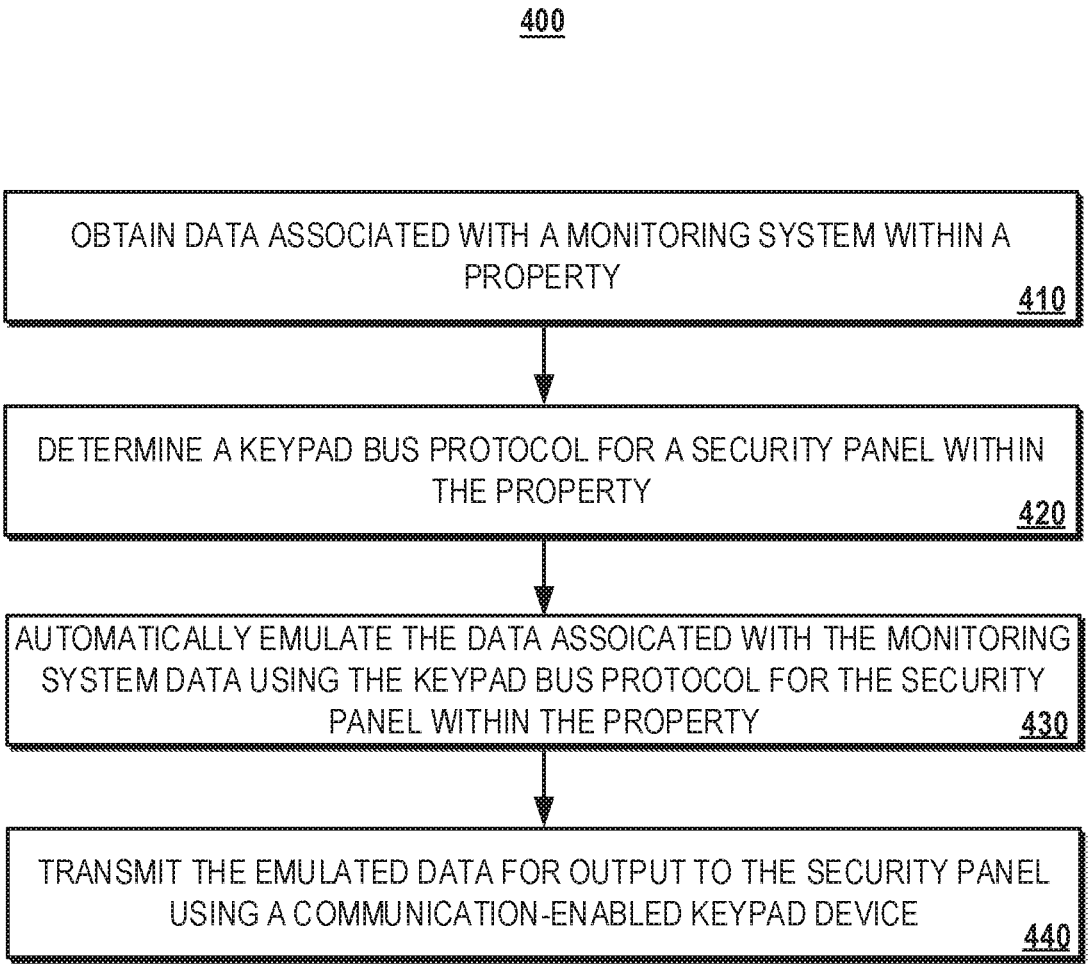
FIG. 4 illustrates an example of a process for converting monitoring system data for output on a keypad bus of a security panel.

FIG. 4 illustrates an example of a process 400 for converting monitoring system data for output on a keypad bus of a security panel. Briefly, the process 400 may include obtaining data associated with a monitoring system within a property (410), determining a keypad bus protocol for a security panel within the property (420), automatically emulating the data associated with the monitoring system data using the keypad bus protocol for the security panel within the property (430), and transmitting the emulated data for output to the security panel using a communication-enabled keypad device (440).

In more detail, the process 400 may include obtaining data associated with a monitoring system within a property (410). For instance, the keypad device 120 may obtain data associated with one or more of the appliances 132, the sensors 134, the user device 140, or the application server 150. The obtained data may include data collected by sensors associated with the monitoring system (e.g., motion sensor data, temperature data, occupancy data, activity data, etc.), historical data associated with the monitoring system (e.g., previously detected patterns, prior emergency conditions triggered by the application server 150, device usage patterns), or input data indicating user inputs relating to the configuration and/or operation of the monitoring system.

The process 400 may include determining a keypad bus protocol for a security panel within the property (420). For instance, the keypad device 120 may identify a keypad bus protocol for the security panel 110. The keypad bus protocol may specify instructions for a keypad connected on the keypad bus of the security panel 110 to perform specified actions in response to receiving key presses on the keypad. As described above, such instructions can be associated with a previously installed security keypad that was installed along with the security panel 110. Once the keypad device 120 is installed as a replacement to the security keypad, then the keypad device 120 can be configured on the keypad bus of the security panel 110.

In some implementations, keypad device 120 identifies the keypad bus protocol for the security panel 110 based on accessing a keypad bus protocol repository 510, which is discussed in greater detail below with respect to FIG. 5. The keypad bus protocol repository 510 may include various keypad bus protocols for different security system manufacturers. After installation, the keypad device 120 identifies the appropriate keypad bus protocol in order to exchange communications with the security panel 110 on the keypad bus as a replacement to the security keypad associated with the security panel 110. The keypad bus protocol repository 510 can also include mappings between key press commands available on the keypad device 120 and the keypad press commands that were originally available on the security keypad associated previously installed on the keypad bus of the security panel 110.

The process 400 may include automatically emulating the data associated with the monitoring system data using the keypad bus protocol for the security panel within the property (430). For instance, the keypad device 120 may automatically emulate the data obtained from the appliances 132, the sensors 134, the user device 140, and/or the application server 150 using the keypad bus protocol for the security panel 110 identified within the keypad bus protocol repository 510.

In some implementations, the keypad device 120 emulates the data by converting portions of the obtained data that are not interpretable by the security panel 110 to portions that are understandable. For example, monitoring system-specific status information can be converted to status information that is capable of being processed by the security system (e.g., converting "emergency condition" indicated by the monitoring system to "intruder alert," which can be understood by the security panel 110). In other implementations, the keypad device 120 emulates the data by identifying an analogous command for the security system that provides the same or similar functionality as a command identified within the obtained data for the monitoring system. For example, the keypad device 120 may identify a command for the security system to update the system status to "alarmed" for a corresponding user command on the monitoring system to indicate that the user 102 is exiting the property (e.g., a key press for "away").

The process 400 may include transmitting the emulated data for output to the security panel using a communication-enabled keypad device (440). For instance, the keypad device 120 may transmit the emulated data for output on a keypad bus of the security panel 110. For example, a monitoring system command to update a system status to "away," may be transmitted by the keypad device 120 on the keypad bus as a command to update the security system status to "armed."

Figure 5:
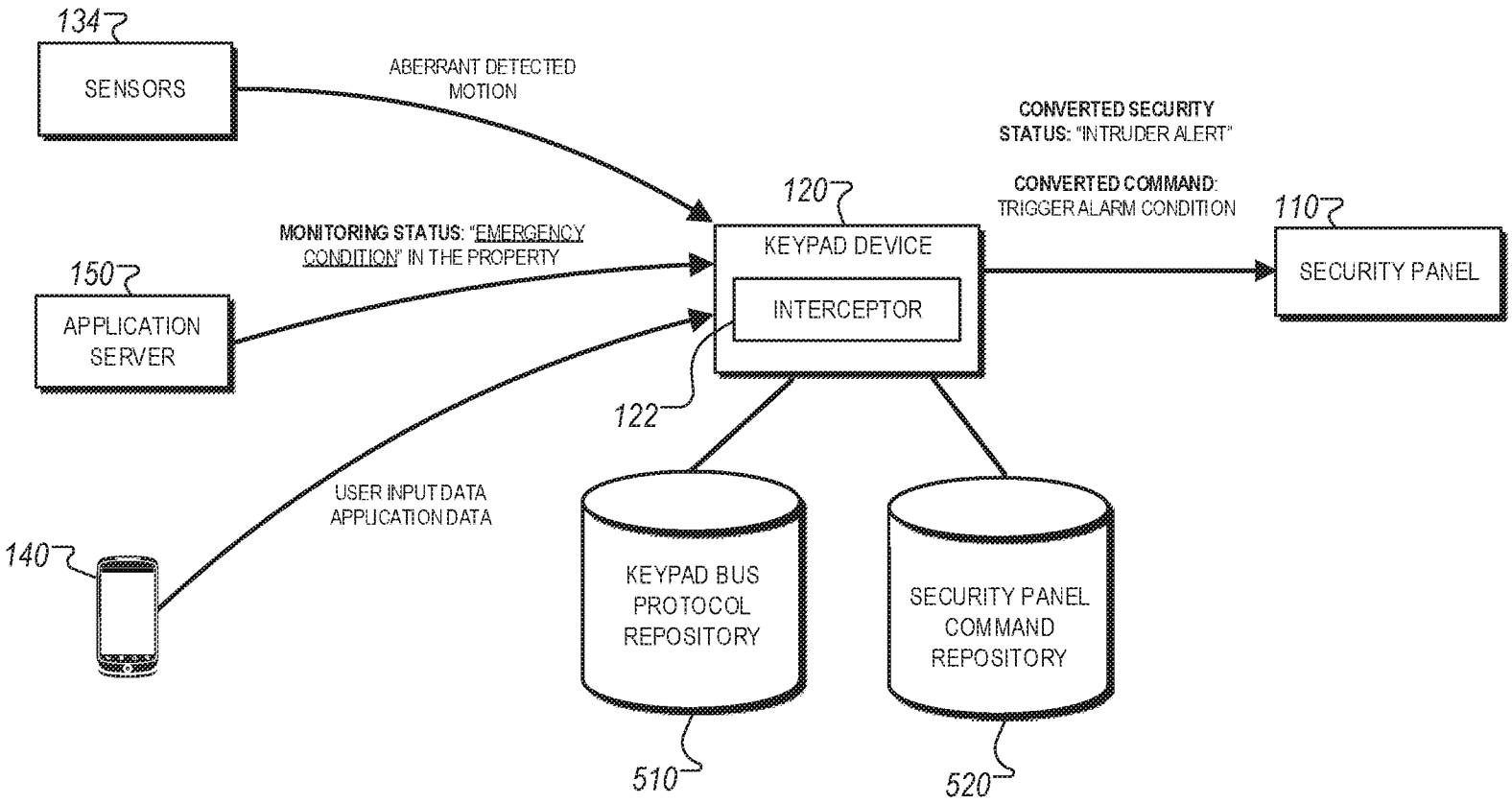
FIG. 5 illustrates an example of a system that is capable of converting monitoring system data for output on a keypad bus of a security panel.

FIG. 5 illustrates an example of a system 500 that is capable of converting monitoring system data for output on a keypad bus of the security panel 110. The system 500 includes the sensors 134, the application server 150, the user device 140, the keypad device 120, and the security panel 110. In some instances, the system 500 is included within the system 100 (e.g., as a sub-system).

In operation, the keypad device 120 can obtain sensor data from the sensors 134 (e.g., occupancy data, motion sensor data, temperature data), data from the application server 150 (e.g., historical monitoring system data), and data from the user device 140 (e.g., user input data, application data). The various types of data received by the keypad device 120 can then be processed and/or analyzed in order to configure or adjust the operation of the security panel 110. As described above, the keypad device 120 is capable of generating a signal that is transmitted on a keypad bus of the security panel 110 in manner similar to that of a preconfigured security keypad that is replaced by the keypad device 120.

The keypad device 120 processes and analyzes the received data from the sensors 134, the application server 150, and/or the user device 140 based on data stored within a keypad bus protocol repository 510 and a security panel command repository 520. The keypad bus protocol repository 510 specifies a list of key press commands that can be processed by the security panel 110. For instance, the key press commands can refer to commands that were capable of being received on the security keypad that was previously associated with the security panel 110 prior to the installation of the keypad device 120. As an example, a key press command can include data indicating a particular button on a keypad was pressed by a user (e.g., a button press for the "away" button as illustrated in FIG. 1B). The key press command may also specify a corresponding action to be taken by the security panel 110 in response to the button press (e.g., setting the security system status to "armed" in response to a button press on the "away" button).

In some implementations, instead of the keypad device 120 obtaining data collected by the sensors 134, as depicted in FIG. 5, the keypad device 120 may additionally or alternatively obtain collected sensor data from the security panel 110. In such implementations, the sensors 134 may be configured to exchange data communications with the security panel 110 (or another type of monitor control unit associated with the monitoring system) that aggregates the collected sensor data and then transmits the collected sensor data to the keypad device 120. In other implementations, certain types of collected sensor data can be transmitted directly to the keypad device 120 (e.g., sensors 134 associated the monitoring system, but not associated with the security system), whereas other types of collected sensor data can be transmitted to the keypad device 120 through the security panel 110 (e.g., sensors 134 associated with the security system, but not associated with the monitoring system).

The keypad bus protocol repository 510 can also include mappings between individual key press commands on the keypad device 120 (or other associated devices such as the user device 140) and corresponding key press commands that are configured on the keypad bus of the security panel 110. For example, the keypad bus protocol repository 510 can map a "home" key press on the keypad device 120 to a "disarm" key press on the keypad bus of the security panel 110. In this example, the keypad device 120 can utilize the mapping to transmit an instruction to "disarm" the security panel 110 in response to receiving a "home" key press on the keypad device 120.

The security panel command repository 520 specifies a list of commands that can be interpreted by the security panel 110 through its keypad bus. For example, the security panel command repository 520 include keypad commands that were capable of being provided on the security keypad of the security keypad prior to the installation of the keypad device 120. The security panel command repository 520 also includes mappings between commands associated with the monitoring system and corresponding commands associated with the security system. As an example, a monitoring system command to indicate an emergency condition within the property 101 can be mapped to a security system command to change the alarm status of the property 101 to "alert." In this example, the monitoring system command is not interpretable by the security system since the security alarm status of the security system can be configured to be set to "disarmed," or "armed" or "alert." In this regard, the security panel command repository 520 enables the keypad device 120 to convert a particular monitoring system commands based on the data received from the sensors 134, the application server 150, and/or the user device 140, to a corresponding security system command that can be processed by the security panel 110.

In the example depicted in FIG. 5, the keypad device 120 receives data from the application server 150 indicating a possible emergency condition within the property 101 based on aberrant movement detected within the property 101 by the sensors 134. Because the sensors 134 are installed in associated with the monitoring system after the security system, as described above, the security panel 110 is unable to process the data collected by the sensors 134. However, the keypad device 120 converts the received sensor data based on accessing the keypad bus protocol repository 510 and the security panel command repository 520.

In response to receiving the motion sensor data and data indicating an "emergency condition" at the property 101, the keypad device 120 determines an appropriate signal needed to trigger the security panel 110. For example, the keypad device 120 accesses the keypad bus protocol to identify a corresponding security status for "emergency condition" as determined by the application server 150. In addition, the keypad device 120 accesses the security panel command repository 20 to identify a corresponding command to transmit to the security panel 110. The keypad device 120 then transmits an instruction to adjust the security status to "intruder alert" (which corresponds to "emergency condition), and a command to the security panel 110 to trigger an alarm condition based on the received motion sensor data. In this regard, data collected by the monitoring system can be used to augment the monitoring operations performed by the security system.

Figure 6:
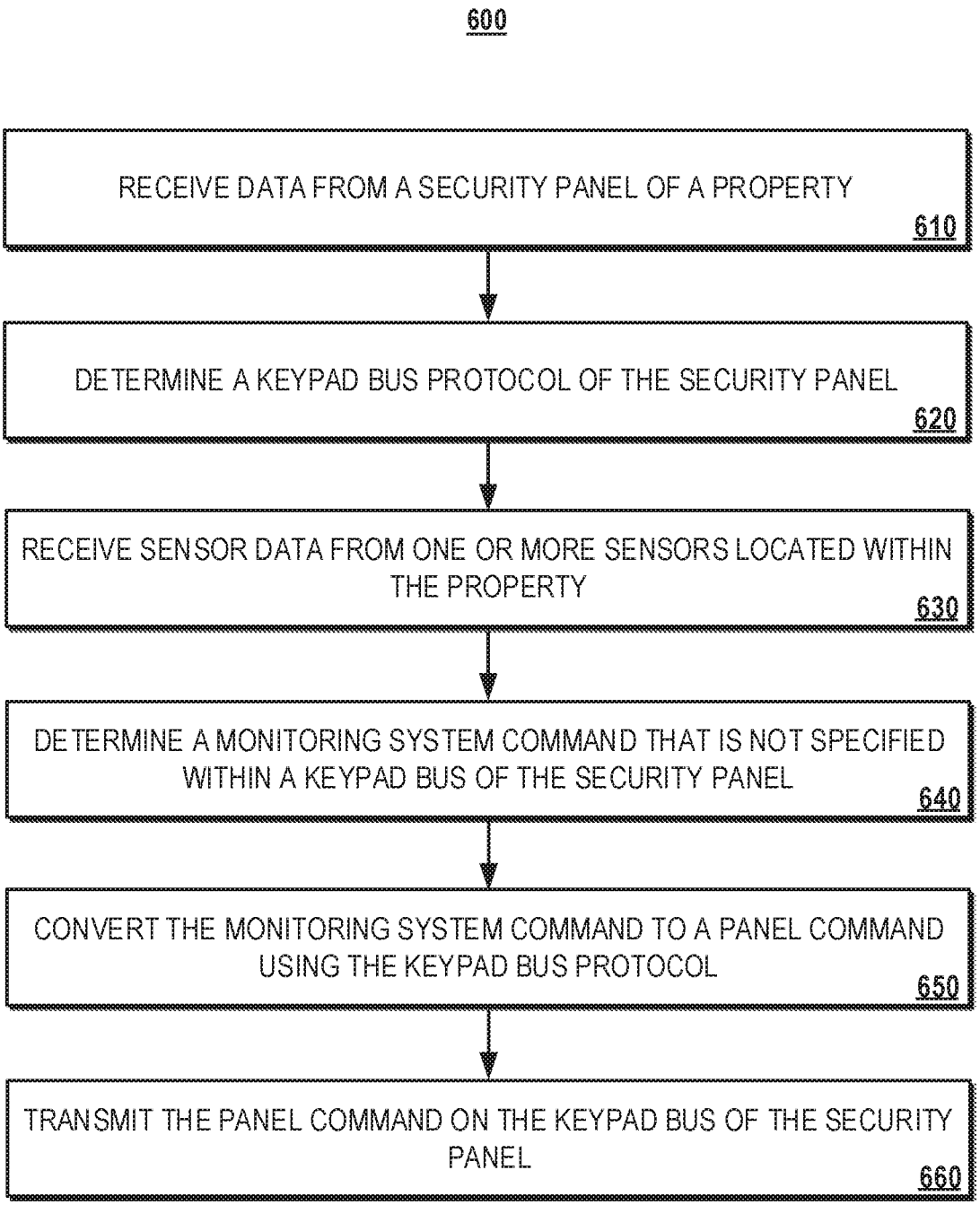
FIG. 6 illustrates an example of a process for converting commands for output on a keypad bus of a security panel.

FIG. 6 illustrates an example of a process 600 for converting commands for output on a keypad bus of a security panel. Briefly, the process 600 can include the operations of receiving data from a security panel of a property (610), determining a keypad bus protocol of the security panel (620), receiving sensor data from one or more sensors located within the property (630), determining a monitoring system command that is not specified within a keypad bus of the security panel (640), converting the monitoring system command to a panel command using the keypad bus protocol (650), and transmitting the panel command on the keypad bus of the security panel (660).

In general, the process 600 is discussed below in reference to the system 100, although any system can perform the operations of the process 600. The descriptions below reference the keypad device 120 for simplicity, though the application server 150 can also perform one or more of the operations of the process 600. For example, the operations discussed below can be performed locally on the keypad device 120, the application server 150, or a combination of both. In some implementations, the keypad device 120 monitors commands received on the keypad bus of the security panel 110 as well as monitoring system commands that are to be transmitted to the security panel. Alternatively, in other implementations, the application server 150 remotely obtains monitoring system over a network and converts commands associated with the monitoring system data to the keypad device 120.

The process 600 can include the operation of receiving data from a security panel of a property (610). For example, the keypad device 120 can receive data from the security panel 110 of the property 101. As discussed above, the received data can include key press commands provided on a physical keypad of the security panel 110, commands previously received on the keypad bus of the security panel 110, among others. In some instances, the keypad device 120 receives the data based on intercepting commands on the keypad bus of the security panel using the interceptor 122. For example, as shown in FIG. 3, the keypad device 120 can intercept an incoming data transmission to the security panel 110 based on monitoring the keypad bus of the security panel 110. Additionally, or alternatively, the keypad device 120 may provide a request to the security panel 110 to respond with information that describes the manufacturer and/or model of the security panel 110. For example, the keypad device 120 may receive data that includes the text "Model X by Manufacturer Y."

The process 600 can include the operation of determining a keypad bus protocol of the security panel (620). For example, the keypad device 120 can determine a keypad bus protocol of the security panel 110 based on the data received from the security panel 110. As discussed above, the keypad device 120 can access a keypad bus protocol repository that specifies multiple keypad bus protocols for different panels. For example, the keypad bus protocol repository can include keypad bus protocols of different security panel manufacturers. In such implementations, the keypad device 120 identifies the appropriate keypad bus protocol for the security panel 110 based on determining that one or more key press commands specified in the received data from the security panel 110 includes a key press command that matches a predetermined command assigned to a particular keypad bus protocol from among the multiple keypad bus protocols. In another example, the keypad device 120 may use data from the security panel 110 that describes the manufacturer and/or model of the security panel 110. In such implementations, the keypad device 120 may identify a keypad bus protocol from the repository that is labeled as being used by the model and/or the manufacturer.

The process 600 can include the operation of receiving sensor data from one or more sensors located within the property (630). For example, the keypad device 120 can receive sensor data from the sensors 134 located within the property 101. As discussed above, the sensor data can include motion detection data, occupancy data, presence data, temperature data, among others. The sensors 134 can be devices that are not capable of directly exchanging communications with the security panel 110, e.g., aftermarket sensors that are installed at the property 101 and use a communication protocol that the security panel 110 does not use. The sensors 134 may be part of a monitoring system that is distinct and independent from the security system of the property 101.

The process 600 can include the operation of determining a monitoring system command that is not specified within a keypad bus of the security panel (640). For example, the keypad device 120 determines a monitoring system command that is not specified within the keypad bus of the security panel 110. As discussed above, the monitoring system command can represent a command that is generated in response to the sensors 134 but is not specified in the keypad bus protocol of the security panel. For example, the monitoring system command can be a signal to update a system status to "away" based on sensor data indicating that the user has left the premises of the property 101. In this example, the monitoring system command is not specified within the keypad bus of the security panel 110 because the monitoring system command is determined based on sensor data collected by the monitoring system (i.e., the command is not determined by the security system based on sensors configured with the security panel). As another example, the monitoring system command can be an instruction to arm the security system of the property 101. In this example, the instruction can be provided by the user 102 through a mobile application on the user device 140 that is associated with the application server 150. Although the mobile application is capable of providing instructions to control the monitoring system, it is unable to provide instructions directly to control the security system that includes the security panel 110.

The process 600 can include the operation of converting the monitoring system command to a panel command using the keypad bus protocol (650). For example, the keypad device 120 converts the monitoring system command to a panel command using the keypad bus protocol determined for the security panel 110 in step 620. As discussed above, the keypad device 120 converts the monitoring system command by identifying a corresponding panel command within the keypad bus protocol. For example, the keypad device 120 can access a security panel command repository specifying multiple panel commands for the security panel 110. The keypad device 120 identifies a panel command from among the multiple panel commands that corresponds to the command determined from the obtained sensor data. For example, the keypad device 120 can use a mapping that associates and/or assigns corresponding monitoring system and panel commands. For example, the mapping can associate a monitoring system command to set the system status to "away" to a panel command "armed" so that the monitoring system command is emulated as the panel command and the emulated panel command is sent on the keypad bus of the security panel 110.

The process 600 can include the operation of transmitting the panel command on the keypad bus of the security panel (660). For example, the keypad device 120 transmits the panel command on the keypad bus of the security panel 110. As discussed above, the panel command can be transmitted in a manner such that the security panel processes and executes the command as if the command was originally transmitted on a physical keypad of the security panel 110.

In some implementations, the monitoring system that includes the sensors 134 and the security system that includes the security panel 110 are managed by different service providers. For example, the monitoring system is managed by an organization that is distinct from another organization that manages the security system. As discussed above in FIG. 1B, the keypad device 120 can be used to bridge communications between the monitoring system and the security system to enable data communications between the two organizations. For instance, data collected by the monitoring service provider, e.g., sensor data collected by the sensors 134 and provided to the keypad device 120, can be used to instruct and/or control the security panel 110 to perform actions responsive to data collected by the monitoring service provider.

In some implementations, the sensor data obtained from the sensors 134 identifies an emergency condition detected by a sensor of the monitoring system, e.g., motion data indicating an unauthorized intrusion in the property 101. In such implementations, the monitoring system command can be one that adjusts the security status of the monitoring system based on the detected emergency condition. When converting the monitoring system command to a panel command, the keypad device 120 identifies an alarm status of the security panel that coincides with the emergency condition detected by the sensors 134. For example, the emergency condition "INTRUSION DETECTED" coincides with the alarm status "HIGH SECURITY" specified in the keypad bus protocol for the security panel 110. In this example, the alarm status "HIGH SECURITY" can represent a heighted monitoring state of the security system when the security system is armed. For instance, if a sensor detects that a windows is opened during the "HIGH SECURITY" status, the security panel may require a user to provide a security code to deactivate the alarm status within a specified period of time, and if no security code is received, trigger an alarm condition at the property.

In some implementations, the process 600 includes additional operations. For instance, the keypad device 120 can identify an alarm status of the security panel 110 indicated by keypad data provided on the keypad bus of the security panel 110. In response to identifying the alarm status, the keypad device 120 generates an update identifying change in alarm status of the security panel, and then provides the update to the application server 150. For example, the keypad device 120 identifies keypress data received on the keypad bus of the security panel 110 that sets the security system to "ARMED" status. In this example, the keypad device 120 transmits an update to the monitor control unit 110 and/or the application server 150. The update identifies the change in the alarm status of the security system so that the change can be used to adjust the operation of the monitoring system. For example, the monitor control unit 110 can enable specific monitoring operations when the security system is set to "ARMED" status, e.g., detecting for intrusions at the property 101. In this regard, the keypad device 120 allows the monitoring system to perform operations based on key press data received on the keypad bus of the security panel 110.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially designed application-specific integrated circuits (ASICs).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. A method comprising:

obtaining, by a keypad device, configuration data for a security panel located in a property;

intercepting, by the keypad device and based on the configuration data for the security panel, a data transmission that (i) is communicated over a keypad bus of the security panel and (ii) indicates a security status of the property determined by the security panel;

receiving, by the keypad device, sensor data from one or more sensors that are (i) located within the property and (ii) associated with a monitoring system of the property that is not configured to exchange communications with the security panel over the keypad bus;

determining, by the keypad device, a change to the security status of the property based on the sensor data;

generating, by the keypad device, a security panel command that corresponds to a monitoring system command associated with the monitoring system, wherein the monitoring system command (i) indicates the change to the security status of the property and (ii) is not specified within the keypad bus of the security panel; and transmitting, by the keypad device and to the security panel, the security panel command on the keypad bus of the security panel.

2. The method of claim 1, wherein:

the method further comprises determining, by the keypad device, a keypad bus protocol of the data transmission communicated over the keypad bus of the security panel in response to intercepting the data transmission communicated over the keypad bus of the security panel; and the security panel command is generated based on the keypad bus protocol of the data transmission communicated over the keypad bus of the security panel.

3. The method of claim 2, wherein the data transmission communicated over the keypad bus of the security panel comprises one or more key press commands previously received by the security panel.

4. The method of claim 3, wherein determining the keypad bus protocol of the data transmission communicated over the keypad bus of the security panel comprises:

accessing, by the keypad device, a keypad bus protocol repository specifying multiple keypad bus protocols; and determining, by the keypad device and based on accessing the keypad bus protocol, that the one or more key press commands include a key press command that matches a predetermined command assigned to a particular keypad bus protocol from among the multiple keypad bus protocols.

5. The method of claim 1, wherein generating the security panel command that corresponds to the monitoring system command comprises:

determining, by the keypad device, that the monitoring system command specifies arming a monitoring system of the property; and determining, by the keypad device, that the security panel command arms a security system of the property.

6. The method of claim 1, wherein:

the one or more sensors are components of the monitoring system that is managed by a monitoring provider;

the security panel is a component of a security system that is managed by a security provider; and the monitoring provider is distinct and independent from the security provider.

7. The method of claim 1, further comprising:

identifying, by the keypad device, an alarm status of the security panel indicated by the data transmission communicated over the keypad bus of the security panel;

in response to identifying the alarm status of the security panel, generating, by the keypad device, an update identifying the alarm status of the security panel; and providing, by the keypad device, the update to a monitoring provider server associated with the monitoring system.

8. A system comprising:

a keypad device; and one or more storage devices storing instructions that are operable, when executed by the keypad device, to cause the keypad device to perform operations comprising:

obtaining, by a keypad device, configuration data for a security panel located in a property;

intercepting, by the keypad device and based on the configuration data for the security panel, a data transmission that (i) is communicated over a keypad bus of the security panel and (ii) indicates a security status of the property determined by the security panel;

receiving, by the keypad device, sensor data from one or more sensors that are (i) located within the property and (ii) associated with a monitoring system of the property that is not configured to exchange communications with the security panel over the keypad bus;

determining, by the keypad device, a change to the security status of the property based on the sensor data;

generating, by the keypad device, a security panel command that corresponds to a monitoring system command associated with the monitoring system, wherein the monitoring system command (i) indicates the change to the security status of the property and (ii) is not specified within the keypad bus of the security panel; and transmitting, by the keypad device and to the security panel, the security panel command on the keypad bus of the security panel.

9. The system of claim 8, wherein:

the operations further comprise determining a keypad bus protocol of the data transmission communicated over the keypad bus of the security panel in response to intercepting the data transmission communicated over the keypad bus of the security panel; and the security panel command is generated based on the keypad bus protocol of the data transmission communicated over the keypad bus of the security panel.

10. The system of claim 9, wherein the data transmission communicated over the keypad bus of the security panel comprises one or more key press commands previously received by the security panel.

11. The system of claim 10, wherein determining the keypad bus protocol of the data transmission communicated over the keypad bus of the security panel comprises:

accessing a keypad bus protocol repository specifying multiple keypad bus protocols; and determining, based on accessing the keypad bus protocol, that the one or more key press commands include a key press command that matches a predetermined command assigned to a particular keypad bus protocol from among the multiple keypad bus protocols.

12. The system of claim 8, wherein generating the security panel command that corresponds to the monitoring system command comprises:

determining that the monitoring system command specifies arming a monitoring system of the property; and determining that the security panel command arms a security system of the property.

13. The system of claim 8, wherein:

the one or more sensors are components of the monitoring system that is managed by a monitoring provider;

the security panel is a component of a security system that is managed by a security provider; and the monitoring provider is distinct and independent from the security provider.

14. The system of claim 8, wherein the operations further comprise:

identifying an alarm status of the security panel indicated by the data transmission communicated over the keypad bus of the security panel;

in response to identifying the alarm status of the security panel, generating an update identifying the alarm status of the security panel; and providing the update to a monitoring provider server associated with the monitoring system.

15. A non-transitory computer-readable storage device storing instructions executable by a keypad device, which, upon such execution, cause the keypad device to perform operations comprising:

obtaining, by a keypad device, configuration data for a security panel located in a property;

intercepting, by the keypad device and based on the configuration data for the security panel, a data transmission that (i) is communicated over a keypad bus of the security panel and (ii) indicates a security status of the property determined by the security panel;

receiving, by the keypad device, sensor data from one or more sensors that are (i) located within the property and (ii) associated with a monitoring system of the property that is not configured to exchange communications with the security panel over the keypad bus;

determining, by the keypad device, a change to the security status of the property based on the sensor data;

generating, by the keypad device, a security panel command that corresponds to a monitoring system command associated with the monitoring system, wherein the monitoring system command (i) indicates the change to the security status of the property and (ii) is not specified within the keypad bus of the security panel; and transmitting, by the keypad device and to the security panel, the security panel command on the keypad bus of the security panel.

16. The device of claim 15, wherein:

the operations further comprise determining, by the keypad device, a keypad bus protocol of the data transmission communicated over the keypad bus of the security panel in response to intercepting the data transmission communicated over the keypad bus of the security panel; and the security panel command is generated based on the keypad bus protocol of the data transmission communicated over the keypad bus of the security panel.

17. The device of claim 16, wherein the data transmission communicated over the keypad bus of the security panel comprises one or more key press commands previously received by the security panel.

18. The device of claim 17, wherein determining the keypad bus protocol of the data transmission communicated over the keypad bus of the security panel comprises:

accessing, by the keypad device, a keypad bus protocol repository specifying multiple keypad bus protocols; and determining, by the keypad device and based on accessing the keypad bus protocol, that the one or more key press commands include a key press command that matches a predetermined command assigned to a particular keypad bus protocol from among the multiple keypad bus protocols.

19. The device of claim 15, wherein generating the security panel command that corresponds to the monitoring system command comprises:

determining, by the keypad device, that the monitoring system command specifies arming a monitoring system of the property; and determining, by the keypad device, that the security panel command arms a security system of the property.

20. The device of claim 15, wherein:

the one or more sensors are components of the monitoring system that is managed by a monitoring provider;

the security panel is a component of a security system that is managed by a security provider; and the monitoring provider is distinct and independent from the security provider.

* * * * *